US006651742B2

(12) United States Patent
Burd et al.

(10) Patent No.: US 6,651,742 B2
(45) Date of Patent: Nov. 25, 2003

(54) METHOD AND APPARATUS FOR ENHANCING OIL RECOVERY

(75) Inventors: James A. Burd, Anchorage, AK (US); Jeffrey R. Corwith, Anchorage, AK (US); Keith W. Lynch, Anchorage, AK (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/244,117

(22) Filed: Sep. 13, 2002

(65) Prior Publication Data

US 2003/0029612 A1 Feb. 13, 2003

Related U.S. Application Data

(62) Division of application No. 09/928,183, filed on Aug. 10, 2001.

(51) Int. Cl.[7] ..... E21B 43/16

(52) U.S. Cl. ..... 166/269; 166/306; 166/374; 417/437

(58) Field of Search ..... 166/66.7, 68, 69, 166/72, 73, 88.4, 101, 105, 327, 328; 417/417

(56) References Cited

U.S. PATENT DOCUMENTS 5,049,046 A * 9/1991 Escue et al.
5,193,985 A * 3/1993 Escue et al.
5,252,043 A * 10/1993 Bolding et al.
5,960,875 A * 10/1999 Beauquin et al.
6,481,500 B1 * 11/2002 Burd et al.

* cited by examiner

*Primary Examiner*—Roger Schoeppel
(74) *Attorney, Agent, or Firm*—Kameron D. Kelly

(57) ABSTRACT

An apparatus and method for enhancing oil recovery through improved injection well performance is provided, wherein a fluid is injected into the well bore at a pressure $P_i$, and a downhole fluid-actuated engine and pump assembly is employed as a booster in order to generate a high pressure output at pressure $P_h$ greater than $P_i$ and a low pressure output at pressure $P_l$ lower than $P_i$; the respective output streams are directed to lower and higher permeability geological strata adjacent the well bore in order to increase production.

3 Claims, 3 Drawing Sheets

METHOD AND APPARATUS FOR ENHANCING OIL RECOVERY

This application is a division of application Ser. No. 09/928,183 filed Aug. 10, 2001, now allowed.

BACKGROUND OF THE INVENTION

1 Field of the Invention

The present invention is broadly concerned with improved systems for enhancing oil recovery by increasing the efficiency of injection wells. More particularly, the invention is concerned with a method and corresponding apparatus for operating an injection well having a well bore extending downwardly through geographical strata with higher and lower permeabilities respectively, wherein a downhole booster pump is employed to generate higher and lower pressure output streams which are directed to the lower and higher permeability strata.

2. Description of the Prior Art

When hydrocarbon producing wells are drilled, initial hydrocarbon production is usually attained by natural drive mechanisms (water drive, solution gas, or gas cap, e.g.) which force the hydrocarbons into the producing well bores. If a hydrocarbon reservoir lacks sufficient pore pressure (as imparted by natural drive), to allow natural pressure-driven production, artificial lift methods (pump or gas lift, e.g.) are used to produce the hydrocarbon.

As a large part of the reservoir energy may be spent during the initial (or "primary") production, it is frequently necessary to use secondary hydrocarbon production methods to produce the large quantities of hydrocarbons remaining in the reservoir. Water flooding is a widespread technique for recovering additional hydrocarbon and usually involves an entire oil or gas field. Water is injected through certain injection wells selected based on a desired flood pattern and on lithology and geological deposition of the pay interval. Displaced oil is then produced into producing wells in the field.

Advancements in secondary hydrocarbon producing technology has led to several improvements in waterflood techniques. For example, the viscosity of the injected water can be increased using certain polymer viscosifiers (such as polyacrylamides, polysaccharides, and biopolymers) to improve the "sweep efficiency" of the injected fluid. This results in greater displacement of hydrocarbons from the reservoir.

The ability to displace oil from all the producing intervals in a hydrocarbon reservoir is limited by the lithological stratification of the reservoir. That is, there are variations in permeability in different geological strata which allow the higher permeability zones to be swept with injected fluid first while leaving a major part of the hydrocarbon saturation in the lower permeability intervals in place. Continued injection of flooding fluid results in "breakthrough" at the producing wells at the high permeability intervals which can render continued injection of the flooding medium uneconomical.

A number of approaches have been used in the past to increase the efficiency of injection well practice and to avoid "breakthrough." This has involved use of gel treatments to decrease the permeability of a higher permeability strata and thereby improve the sweep efficiency. Attempts have also been made to use polymer gels having selective penetration properties which will preferentially enter high permeability strata. However, these polymers are rare and expensive.

SUMMARY OF THE INVENTION

The present invention is broadly directed to systems for operating injection wells having a well bore extending downwardly through geological strata or zones having higher and lower fluid permeabilities, and includes the steps of injecting a fluid into the well bore at a pressure $P_i$, and using the injected fluid to generate first and second higher and lower pressure output streams at pressures $P_h$ and $P_l$, respectively, whereupon such streams are directed out of the well bore and into the appropriate geological stratum. In preferred forms, the injected fluid is directed to a fluid-actuated downhole engine and pump assembly, and a first portion of the injected fluid is delivered to the engine which creates work with consequent reduction in the pressure of the first fluid portion to a level below the initial pressure $P_i$. Some of the created work is transferred to the pump to generate the high pressure output stream. A second portion of the injected fluid is delivered to the pump and is pressurized therein, the pressurized pump output comprising at least a part of the high pressure output stream.

In practice, the engine and pump assembly is located within the well bore proximal to the strata to be treated, typically by placing the assembly within a tubing string. In order to permit passage of the output streams through the geological strata, the well casing is divided with appropriately located and sized output openings.

The preferred engine and pump assembly includes a primary block having a valve chamber, an engine piston chamber, a pump piston chamber, an injected fluid inlet, and high and low pressure fluid delivery outlet openings. The primary block also includes an elongated operator shaft extending along the length of the block from the valve chamber and through the engine and piston pump chambers. This shaft supports an engine piston slidable within the engine chamber and a pump piston slidable within the pump piston chamber. A movable valve member is also located within the valve chamber. In order to direct the incoming injected stream and deliver the desired outputs, the primary block has an injected fluid passageway system operably coupling the valve chamber and the engine piston chamber for alternate delivery of injected fluid into the engine piston chamber on opposite sides of the engine piston, in response to the location of the valve member. This injected fluid passageway system also couples the injected fluid inlet and the pump piston chamber for alternate delivery of injected fluid to the pump piston chamber on opposite sides of the pump piston. The injected fluid passageway system is in communication with the low pressure fluid delivery opening, whereas the high pressure fluid delivery opening of the block is in operative communication with the pump piston chamber.

DETAILED DESCRIPTION OF THE PREFERRED EMBODIMENT

Figure 1:
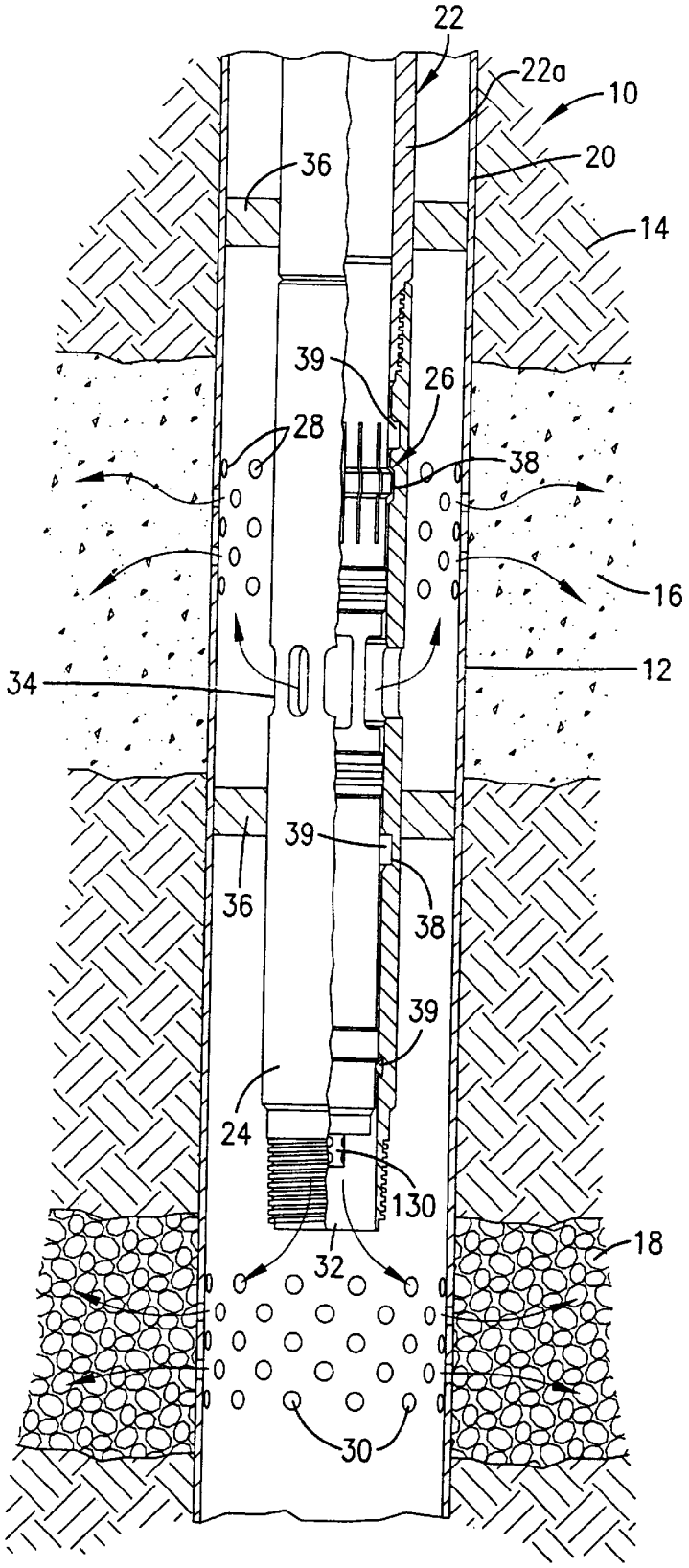
FIG. 1 is a vertical sectional, partially fragmentary view illustrating the preferred injection well assembly of the invention positioned within a well bore adjacent geological strata of higher and lower fluid permeabilities and operable to generate high and low pressure output streams for delivery into the strata.

Turning now to the drawings, and particularly FIG. 1 an injection well assembly 10 is illustrated in use within a well bore 12 extending downwardly through the earth 14 and through a geological strata 16 and 18 of higher and lower permeability, respectively. Broadly speaking, the well assembly 10 includes a well casing 20, an elongated, sectionalized tubing string 22 ending in a tubing nipple 24, and a fluid-actuated engine and pump assembly 26 telescoped within nipple 24.

In more detail, casing 20 is essentially conventional sectionalized well casing, but includes a first series of apertures 28 adjacent higher permeability strata 16, and a second series of apertures 30 adjacent low permeability strata 18.

Tubing string 22 is also conventional and is made up of a number of end-to-end interconnected tubular sections 22*a* as well as nipple 24 presenting an open outlet end 32. As illustrated, nipple 24 is threadably secured to the next adjacent section 22*a*, and has a series of circumferentially spaced outlet slots 34. String 22 is positioned within casing 20 by means of vertically spaced apart packing rings 36. The inner face of nipple 24 has appropriate grooves 38 and connectors 39 to insure proper positioning of assembly 26 therein. Although nipple 24 is illustrated in the drawing figures as being disposed at the lower terminal end of tubing string 22, additional tubing sections can be coupled to the lower end of nipple 24 and extend downwardly therefrom.

Figure 2:
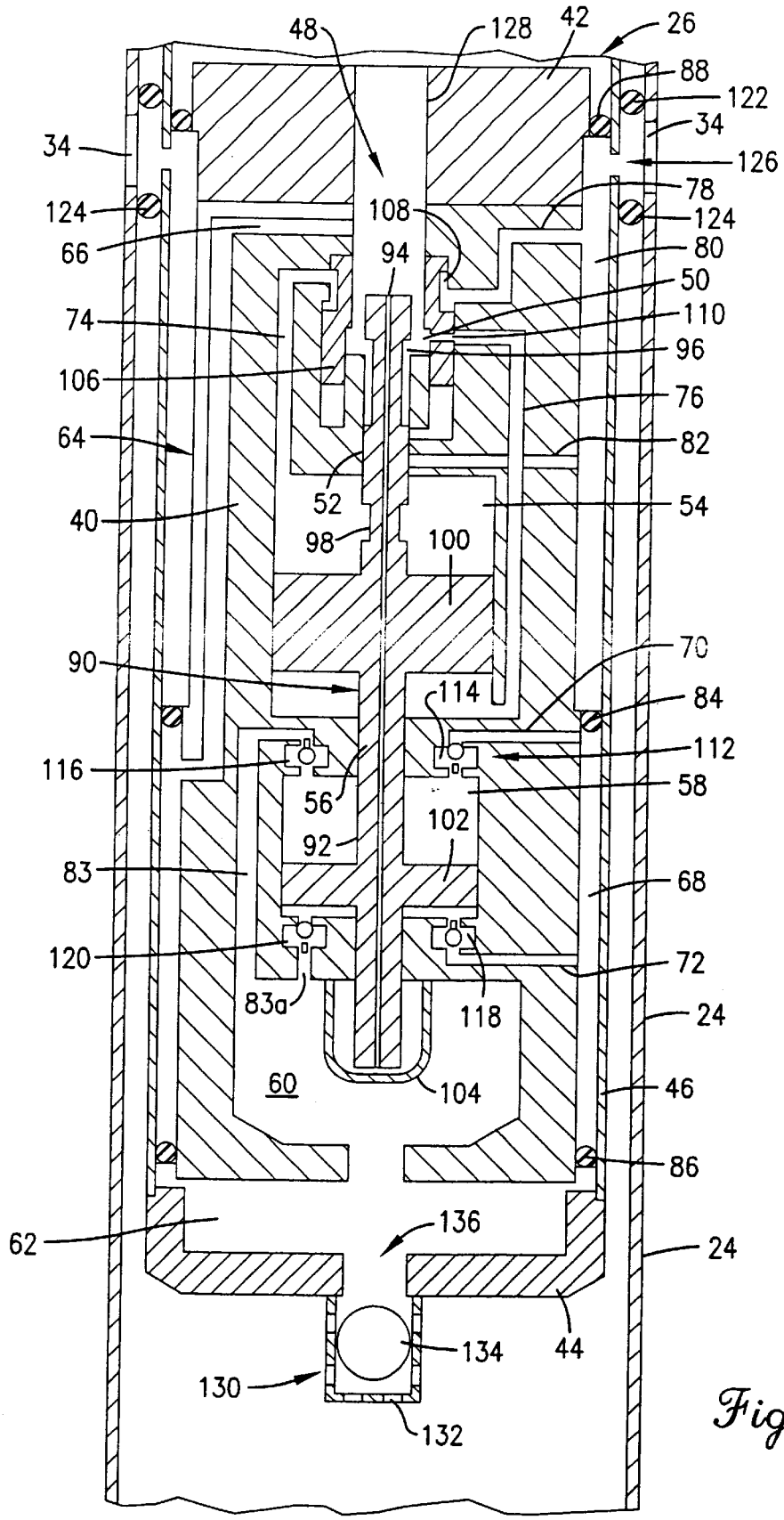
FIG. 2 is an enlarged, somewhat schematic vertical sectional view depicting the internal construction of the engine and pump assembly used in the injection well assembly, and illustrating the engine and pump assembly at the beginning of the upstroke thereof.
Figure 3:
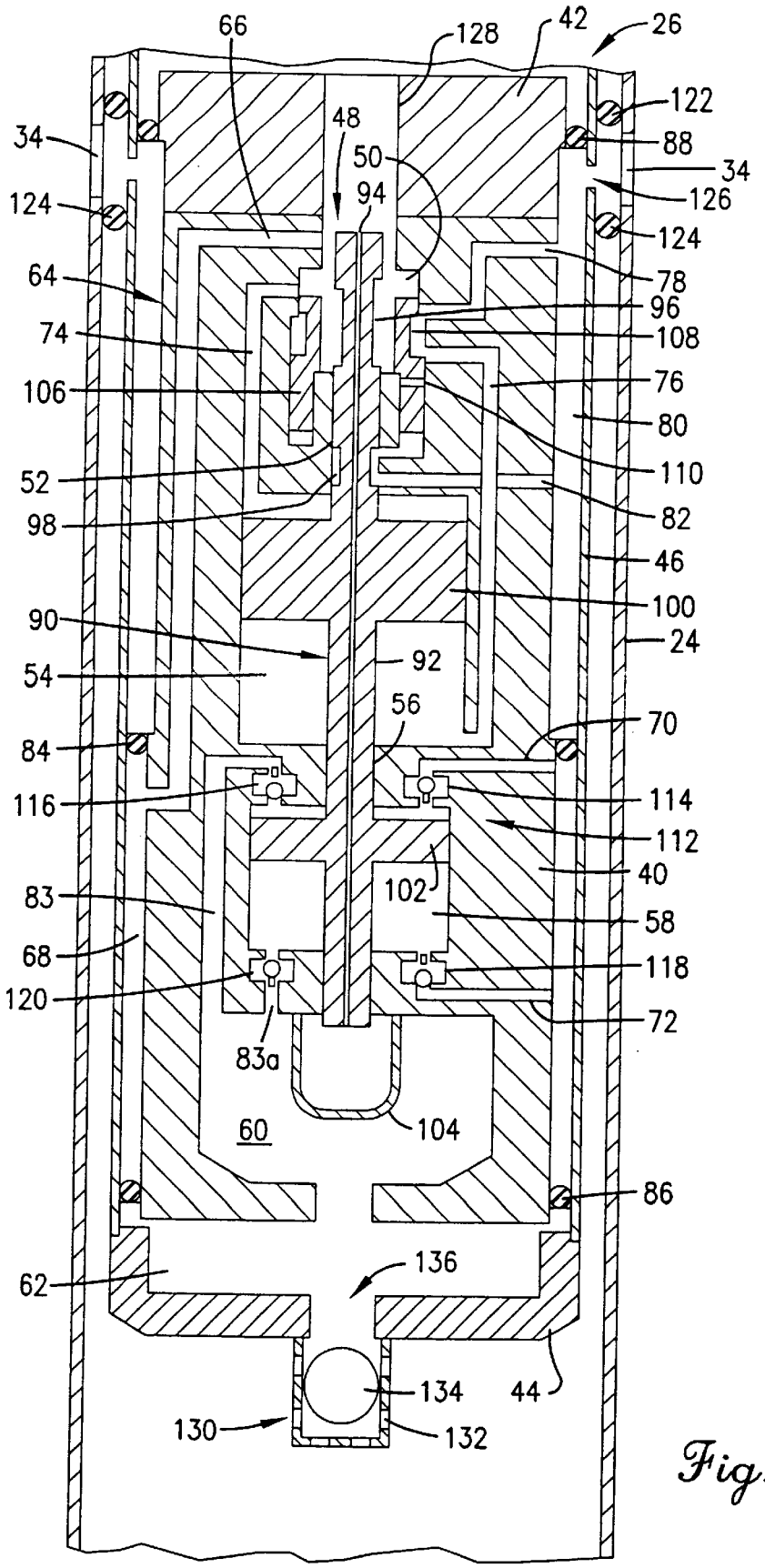
FIG. 3 is a view similar to that of FIG. 2, but illustrating the engine and pump assembly at the beginning of the downstroke thereof.

Referring now to FIGS. 2 and 3, engine and pump assembly 26 has a primary block 40, an upper inlet block 42, a lower cap block 44, and an outer tubular wall 46 coupled with cap block 44 and extending upwardly past block 42.

Primary block 40 includes, from top to bottom, an injection fluid inlet 48, a valve chamber 50, a bore section 52, an engine piston chamber 54, a bore section 56, a piston pump chamber 58, a high pressure fluid chamber 60 and a high pressure outlet chamber 62. Additionally, block 40 has an injected fluid passageway system broadly referred to by the numeral 64 and made up of: a passageway 66 extending from inlet 48 downwardly and communicating with an annular passageway 68 formed between the outer surface of block 40 and wall 46; upper and lower passageways 70 and 72 in communication with passageway 68 and extending to a point above and below chamber 58; a passageway 74 extending between the upper end of valve chamber 50 and communicating with the upper end of engine piston chamber 54; and a passageway 76 extending from valve chamber 46 to communication with engine piston chamber 54 adjacent the lower end thereof. Block 40 further has a low pressure fluid passageway system including a dogleg passageway 78 extending between valve chamber 50 and an annular passageway 80 formed between the outer surface of block 40 and wall 46; and a passageway 82 extending between the lower end of valve chamber 50 and communicating with passageway 80. Finally, block 40 has high pressure fluid outlets 83 and 83*a* respectively extending from the upper and lower ends of chamber 58 and communicating with chamber 60.

It will be observed that annular passageway 68 and 80 are separated by an intermediate sealing ring 84, whereas a lower sealing ring 86 defines the bottom extent of passageway 68 and an upper sealing ring 88 defines the upper boundary of passageway 80.

A shiftable operator 90 is housed within block 40 and extends between upper valve chamber 50 and lower piston pump chamber 58. Operator 90 includes an elongated shaft 92 having a continuous axial bore 94. A pair of spaced apart recesses 96 and 98 are formed in the upper end of shaft 92 and are important for purposes to be described. Shaft 92 also supports an engine piston 100 which is slidable within chamber 54 and a pump piston 102 slidable within chamber 58. It will be noted that a cup-like injection fluid-retaining cup member 104 is affixed to the upper surface of chamber 60 and receives the lowermost end of shaft 92.

The valving system within block 40 includes a shiftable, annular valve member 106 situated within chamber 50. Valve member 106 includes an upper, annular recess 108 formed in the outer sidewall thereof, as well as a lateral bore 110. Valve member 106 is vertically shiftable within chamber 50, with the lower end of valve member 106 located outboard of bore section 52. The valving system further includes a check valve assembly 112 adjacent piston pump chamber 58. Specifically, a pair of upper check valves 114, 116 are located above chamber 58 and in communication therewith. Check valve 114 also communicates with passageway 70, while check valve 116 communicates with passageway 83. A pair if lower check valves 118, 120 are adjacent the bottom of chamber 58 and communicate with the latter as well as passageways 72 and 83*a*, respectively.

Engine and pump assembly 26 is located within nipple 24 by conventional means, including a pair of sealing rings 122, 124 located on opposite sides of output slots 34. Rings 122, 124 are also located on opposite sides of a series of openings 126 provided through tubular wall 46.

Inlet block 42 is positioned above primary block 40 and includes an elongated, a central inlet passageway 128 which communicates with inlet 48 of primary block 40. Although not shown in FIGS. 2 and 3, it will be understood that passageway(s) are provided throughout the entire tubing string 22 so as to permit injection of fluid.

Lower cap block 44 includes a caged ball check valve 130 including an apertured housing 132 and a check ball 134 captively retained within housing 132. Housing 132 is concentric with a pressurized fluid outlet port 136 formed through cap block 44.

Figure 4:
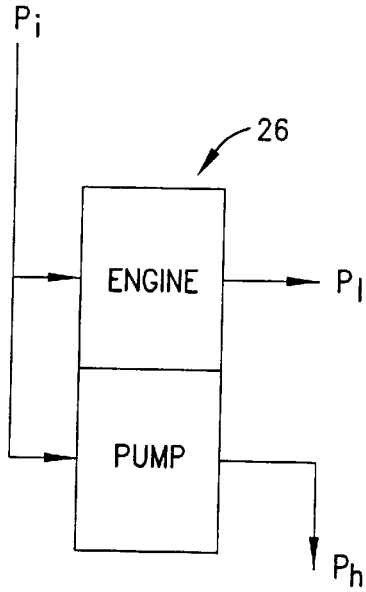
FIG. 4 is a block diagram schematically illustrating the injection fluid flow to the engine and pump assembly, as well as the higher and lower pressure output streams therefrom.

The principle operation of the preferred injection well assembly 10 can be understood from a consideration of FIG. 4. That is, injection fluid at pressure $P_i$ is delivered to engine and pump assembly 26, with a first portion of the injection fluid being directed to the engine for operation thereof, whereas a second portion of the injection fluid is directed to the pump in order to pressurize the second portion. Thus, engine and pump assembly 26 produces two output streams, namely an output stream of pressure $P_l$ (which is lower than $P_i$) from the engine, and an output stream of pressure $P_h$ (which is higher than $P_i$) from the pump.

Figure 5:
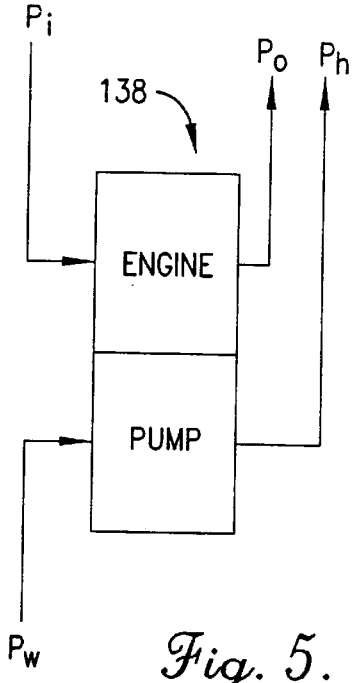
Fig. 5. PRIOR ART
FIG. 5 is a block diagram schematically illustrating a prior art injection and pump assembly used in production wells to assist in recovery from the production wells.

The preferred engine and pump assembly 26 is a modified version of an assembly 138 illustrated in FIG. 5. Such prior art equipment is used in production wells (rather than injection wells) and is operated by injection fluid at pressure $P_i$, producing a lower pressure engine output stream at pressure $P_o$. The engine in turn operates the pump which pumps well fluid at an inlet pressure of $P_w$ and an outlet pressure of $P_h$($P_h$ being higher than $P_w$). In normal practice, the output streams from the engine and pump are comingled to yield a single output stream of intermediate pressure between $P_o$ and $P_h$.

The detailed operation of injection well assembly 10 is best understood from a consideration of FIGS. 2 and 3. FIG. 2 depicts engine and pump assembly 26 at its lowermost position, at the start of the upstroke, whereas FIG. 3 depicts the assembly at its uppermost position, at the beginning of the downstroke. In the ensuing discussion, it will be assumed that the assembly 26 is fully primed and is operating normally.

Referring first to FIG. 2, at the beginning of the upstroke, the injection fluid at pressure $P_i$ is present in the following: inlet passageway 128, inlet 48, bore 94 of shaft 92, cup member 104, valve chamber 50 between the valve and adjacent portions of shaft 92, the lower righthand generally L-shaped section of the valve chamber 50 located below valve member 106, the lower lefthand region of valve chamber 50 located below valve member 106, passageway 66, annular passageway 68 between sealing rings 84 and 86, lateral passageways 70 and 72, check valve 118 and the area within chamber 58 below piston 102, lateral valve bore 110, passageway 76 and the region within chamber 54 below piston 100. Low pressure fluid at pressure $P_l$ is present in the following: passageway 74 and the region of chamber 54 above piston 100, passageway 82 and annular passageway 80 between sealing rings 84 and 88, dog-leg passageway 70, openings 126, the annular space between sealing rings 122, 124, and outlet slots 34. Finally, high pressure fluid at pressure $P_h$ is present in the following: the region of chamber 58 above piston 102, check valves 114, 116 and 120, passageways 83 and 83*a*, chambers 60 and 62, check valve 130, the region below the assembly 26, and in the annular space between tubular wall 46 and nipple 24 up to the level of seal 124.

As the injection fluid is delivered to engine piston chamber 54, the piston 100 is moved upwardly, owing to the fact that the fluid above the piston 100 is at the lower pressure $P_l$ below $P_i$. This upward movement of the piston serves to eject the low pressure fluid through passageways 74 and 78 for ultimate delivery out through slots 34. At the same time, because pistons 100 and 102 are coupled, piston 102 moves upwardly to eject the high pressure fluid above the piston 102 through conduit 83 to be finally outputted through check valve 130. In this respect, the imbalance of forces created by differential pressures and/or differential areas on lower and upper pistons 102, 106 together with the direct coupling of the two pistons allows the high pressure fluid to be ejected in this manner.

At the top of the stroke, engine and pump assembly 26 assumes the position illustrated in FIG. 3. It will be observed that in this position valve member recess 108 serves to communicate passageway 76 and passageway 78 and that bore 110 is shifted out of communication with passageway 76. In this uppermost position, the injection fluid at pressure $P_i$ is present in the following: inlet passageway 128, inlet 48, shaft bore 94 and cup member 104, the inner free volume of the valve chamber 50 between the inner valve surfaces and shaft 92 including bore 110, passageway 66 and annular passageway 68, upper and lower passageways 70 and 72, check valve 114 and the region within chamber 58 above piston 102, passageway 74 and the region within chamber 54 above piston 100. The lower pressure fluid at pressure $P_l$ is present in the following: the region within chamber 54 below piston 100, passageway 76, recess 108, dog-leg passageway 78, annular passageway 80, openings 126, the annular region between seals 122 and 124, and slots 34, passageway 82 and recess 98. The higher pressure fluid at pressure $P_h$ is present in the following: the region within chamber 58 below piston 102, check valves 116, 118 and 120, passageways 83 and 83*a*, chambers 60 and 62, outlet port 136, check valve 130 and the region below the assembly 126, and the annular space around assembly 26 up to seal 124. During the downstroke, the lower pressure fluid at pressure $P_l$ is delivered through passageway 76, recess 108, dog-leg passageway 78, openings 126 and slots 34. At the same time, pressurized fluid at pressure $P_h$ is delivered through passageway 83*a* for ultimate passage through the check valve 130.

Cycling of the assembly 26 as described above thus creates, both during upstroke and downstroke, a low pressure $P_l$ output delivered through slots 34 and a high pressure $P_h$ output delivered through check valve 130. Again referring to FIG. 1, it will be seen that these respective outputs pass through apertures 28 and 30 into strata 16 and 18.

It should be understood that the system described above can be easily reconfigured to accommodate situations in which the lower permeability strata is located above the higher permeability strata. In such a scenario, the entire engine and pump assembly can simply be physically inverted or, alternatively, the flow of the injection fluid in the assembly can be re-routed so that the high pressure fluid exits at a point above the low pressure fluid.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. An engine and pump assembly comprising:

a primary block including a valve chamber, an engine piston chamber, a pump piston chamber, an injected fluid inlet, and high and low pressure fluid delivery outlet openings;

an elongated operator shaft extending along the length of said primary block from said valve chamber and through said engine and pump piston chambers, said shaft supporting an engine piston slidable within the engine chamber and a pump piston slidable within the pump piston chamber;

a movable valve member disposed within said valve chamber; and an injected fluid passageway system operably coupling said valve chamber and said engine piston chamber for alternate delivery of injected fluid to the engine piston chamber on opposite sides of said engine piston and in response to the location of said valve member, said injected fluid passageway system also coupling said injected fluid inlet and said pump piston chamber for alternate delivery of injected fluid to the pump piston chamber on opposite sides of said pump piston, said injected fluid passageway system in communication with said low pressure fluid delivery opening, said high pressure fluid delivery opening in operative communication with said pump piston chamber.

2. The assembly of claim 1, said shaft having an elongated, axial bore extending the length thereof, one end of said bore in communication with said injected fluid inlet, there being an injected fluid retainer adjacent the other end of said shaft bore.

3. The assembly of claim 1, including a check valve assembly operably coupled with said injected fluid passageway system and said high pressure delivery opening adjacent said pump piston chamber.

* * * * *